United States Patent [19]

Comeau

[11] Patent Number: 4,693,402

[45] Date of Patent: Sep. 15, 1987

[54] SPORTS PACK

[76] Inventor: Perry Comeau, 7821 W. 100th St., Overland Park, Kans. 66212

[21] Appl. No.: 820,014

[22] Filed: Jan. 21, 1986

[51] Int. Cl.[4] ..... A45F 3/04

[52] U.S. Cl. ..... 224/215; 224/907; 224/919; 206/315.1

[58] Field of Search ..... 224/215, 209, 258, 917, 224/202, 211; 206/315.1

[56] References Cited

U.S. PATENT DOCUMENTS

| | | | |
|---|---|---|---|
| 2,047,079 | 7/1936 | MacMurray | 224/202 |
| 2,224,568 | 12/1940 | Altorfer | 224/917 X |
| 2,620,479 | 12/1952 | Buck | 224/202 X |
| 3,933,241 | 1/1976 | Tassone et al. | 206/315.1 X |
| 4,213,549 | 7/1980 | Hibbard | 224/209 |
| 4,378,866 | 4/1983 | Pelavin | 206/315.1 X |
| 4,518,107 | 5/1985 | Amos | 224/258 X |

FOREIGN PATENT DOCUMENTS

| | | | |
|---|---|---|---|
| 816256 | 2/1937 | France | 224/917 |
| 780127 | 7/1957 | United Kingdom | 224/215 |

*Primary Examiner*—Stephen Marcus
*Assistant Examiner*—Robert M. Petrik
*Attorney, Agent, or Firm*—Head, Johnson, Stevenson

[57] ABSTRACT

A pack for wearing on the back of the user for carrying sport equipment, the pack being formed of a back portion of flexible material configured to generally cover the back of the user, there being a first and second opening in the back portion adjacent the opposed lower corners thereof, a left and a right shoulder strap each being affixed at one end to the back portion upper edge, the shoulder straps extending through the openings in the back portion and being adapted to be attached at their other ends together in the front of the user so that the straps extend over the shoulders of the user, a generally tubular elongated portion affixed to the back surface of the back portion and extending diagonally thereacross adapted to receive a baseball bat, tennis racket, hockey stick, etc. therein, and a sack portion of flexible material secured to the back portion back surface and being open at the top and adapted to receive balls and other playing equipment.

4 Claims, 6 Drawing Figures

SPORTS PACK

SUMMARY OF THE INVENTION

Youth, and especially boys, typically accumulate a large amount of sporting equipment which must be transported to playing areas. For instance, most boys own a baseball bat, at least one glove, balls, tennis rackets, footballs, basketballs and so forth. Carrying all of this equipment can be a problem, especially when riding a bicycle.

The present invention provides a sports pack which can be used to store and easily transport all of the sporting equipment typically used by a boy. The sport pack is formed of a back portion of flexible, strong material, such as canvas, or the like, having a top edge, a lower edge and side edges with the front surface adapted to engage the back of the user. A pair of straps are each affixed at one end to the back portion top edge. The back portion has openings adjacent the lower opposed corners. The straps extend over the shoulder of the user, through the openings and attach to each other in the front of the user so that the back portion is securely, yet easily, held on the back of the user.

Secured to the back surface of the back portion is an elongated, generally tubular, portion extending diagonally across the back portion. This tubular portion is configured to receive a baseball bat therein. A second, shorter, tubular portion may also be affixed to the back portion back surface extending diagonally from adjacent the top edge of the back portion and at an angle intersecting the angle of the longitudinal axis of the first mentioned tubular portion. This second, shorter, tubular portion may be used such as to store tennis ball cans therein.

Secured to the back portion and encompassing the tubular portions, is a sack portion which is open at the top. The sack portion may be made of highly flexible light weight material such as mesh material, and preferably includes a draw string across the top. The sack portion provides a receptacle for baseballs, tennis balls, footballs, basketballs, soccer balls, hockey equipment, and so forth.

Secured to the back portion adjacent the side edges are a plurality of straps which can be employed to retain ball gloves. A plurality of pockets may also be provided on the back portion, back surface adjacent the side edges for retaining coins, and other small objects.

The sports pack provided herein not only affords a means of easy transportation of sporting equipment as used by boys, but a means of keeping such sporting equipment in a compact storage area when the back pack is not being used to transport the equipment.

A better understanding of the invention will be had by referring to the following specification and claims, taken in conjunction with the attached drawings.

DESCRIPTION OF A PREFERRED EMBODIMENT

Figure 4:
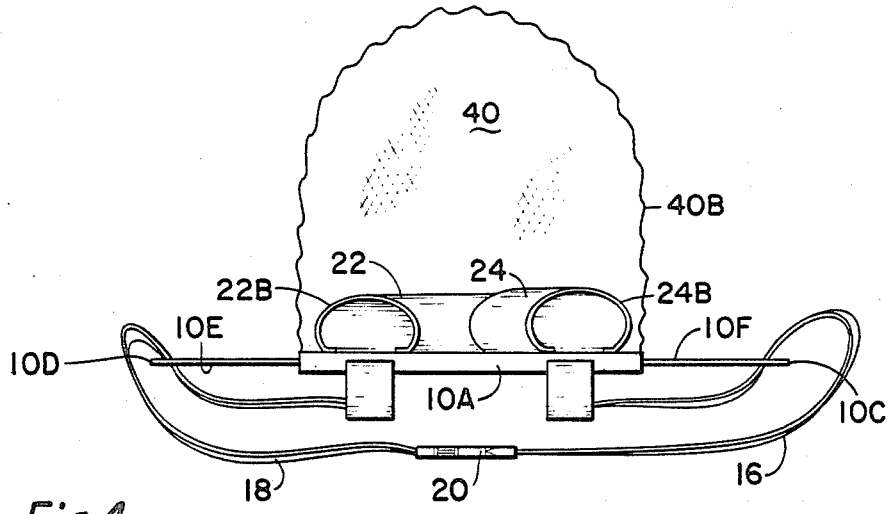
FIG. 4 is a top view of the sports pack.

Referring to the drawings and first to FIGS. 1 through 4 a sports pack of this invention is shown. The sports pack is formed of a back portion generally indicated by the numeral 10 having an upper edge 10A, a lower edge 10B, a left side edge 10C, a right side edge 10D, a front surface 10E which contacts the back of the user when the pack is in position on a user and a rear surface 10F. The back portion 10 may be formed of flexible material of good strength such as canvas like material or a combination of cotton and a man made material such as polypropylene.

The back portion has a first opening 12 adjacent the lower left hand corner and a second opening 14 adjacent the lower right hand corner. Affixed to the upper edge 10A of the back portion is one end of a first strap 16, the strap extending through the first opening 12. Also, affixed to the upper edge of the back portion is one end of a second strap 18 which extends through opening 14 in the back portion. The straps 16 and 18 extend, when the sports pack is being used, in the front of the user. A buckle 20 has a portion affixed to the other end of each of the straps so that the buckle may be connected together in front of the user.

While in the drawings the straps 16 and 18 extend through the openings 12 and 14, respectively, on the same side of the back portion as each of the straps, it can be seen that if desired the straps can be crossed in front of the user so that first strap 16 extended through opening 14 and second strap 18 extended through opening 12, with the ends buckled together in the illustrated manner. This cross arrangement in front of the user can be employed to more securely hold the sports pack on the user if desired.

Figure 5:
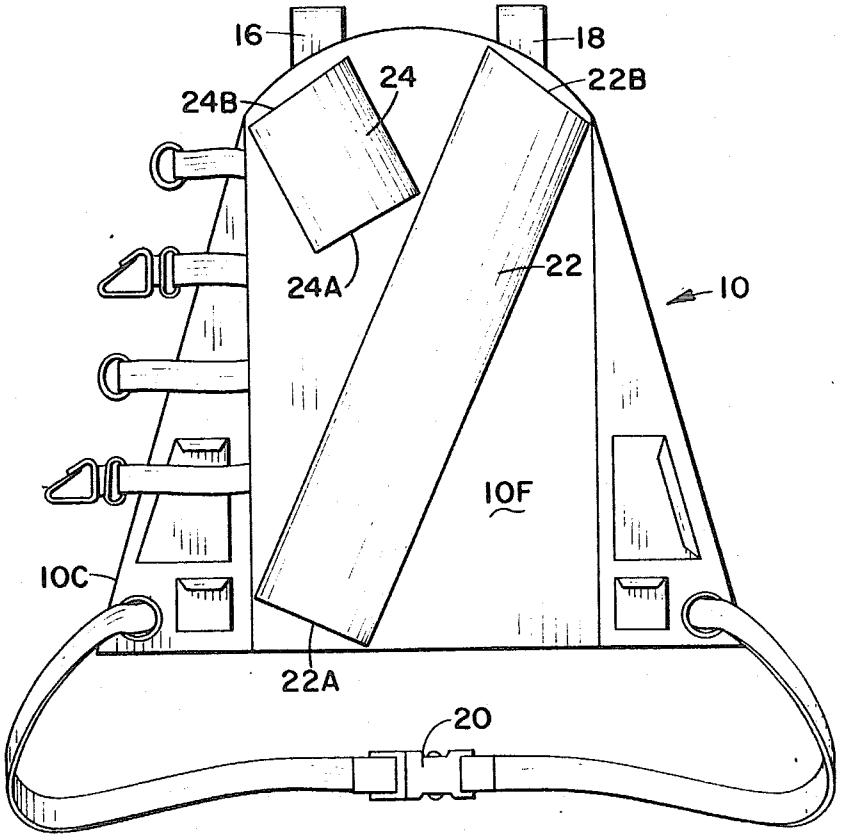
FIG. 5 is a rear elevational view of the sports pack but shown without the sack portion so as to more clearly reveal other features.

Affixed to the back surface 10F of the back portion, as best shown in FIG. 5, is a generally tubular, elongated portion 22 which is closed at the bottom 22A and open at the top 22B. The tubular portion 22 is preferably made of strong, flexible material, such as the same material of which the back 10 is formed, although it can be made of light weight ridge material such as a plastic tube. The tubular portion 22 is configured and dimensioned such as to hold a ball bat.

A second short length tubular portion 24 is also affixed to the rear surface 10F of the back portion, the short, tubular portion having a closed bottom 24A and an open top 24B. The short, tubular portion 24 can be constructed as the longer, tubular portion 22 and dimensioned to receive objects such as balls or a can of tennis balls.

Figure 1:
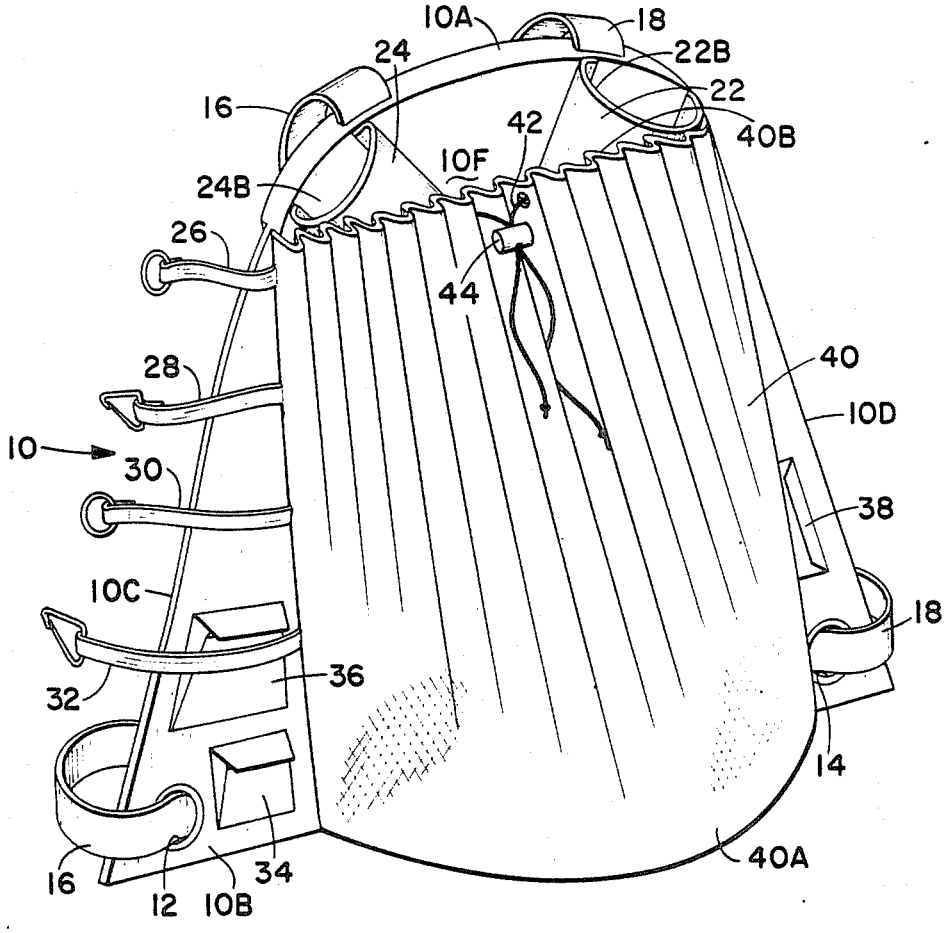
FIG. 1 is an isometric view of a sports pack employing the principles of this invention shown from the rear and showing the pack in the position where it may be received on the back of a user.
Figure 3:
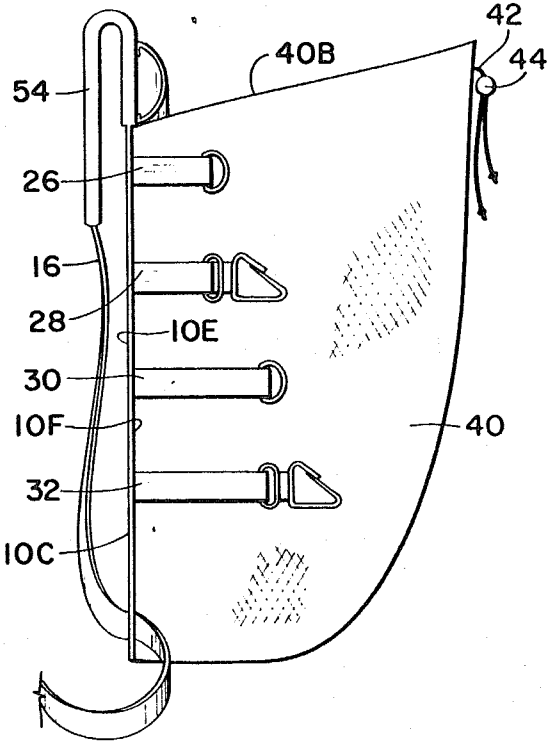
FIG. 3 is a view of one side of the sports pack of FIGS. 1 and 2.

Secured adjacent one side edge of the back portion back surface are a plurality of short length straps, four being shown, and indicated by the numerals 26 through 32 (See FIG. 1). These short straps have hooks at the outer end which may be connected to each other and may be employed to attach items such as ball gloves.

A plurality of pockets are utilized, four being shown in FIG. 5, and three being seen in FIG. 1 identified by numerals 34, 36 and 38. The pockets are attached to the back portion back surface 10F and provide means for receiving small items, including coins, marbles or the like.

Affixed to the back surface of the back portion is a sack portion 40 having a closed bottom 40A and an open top 40B. The sack portion 40 may be made of very flexible light weight material such as mesh material. A draw string 42 and closer 44 are provided so that the sack portion 40 may be readily opened and closed.

Figure 6:
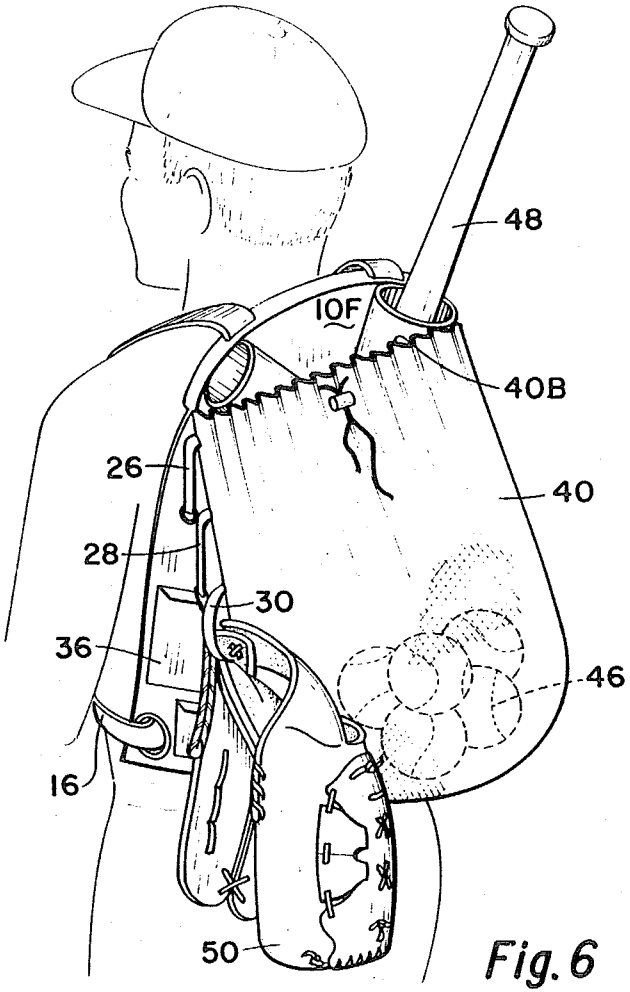
FIG. 6 is an isometric view of a sports pack of the invention shown on a user and shown as employed to retain playing equipment.

FIG. 6 shows the sport pack as in use with balls 46 retained in the sack portion 40, a bat 48 retained in the tubular portion 22, and a ball glove 50 retained by strap 30. This view is illustrative of how a user may employ the sport pack when prepared to play baseball. It can be seen that a tennis racket can easily be positioned in the sack portion 40 with the handles extending upwardly out of the top 40B of the sack and that the sack portion 40 can receive a basketball, a football, a soccer ball or similar objects therein.

Figure 2:
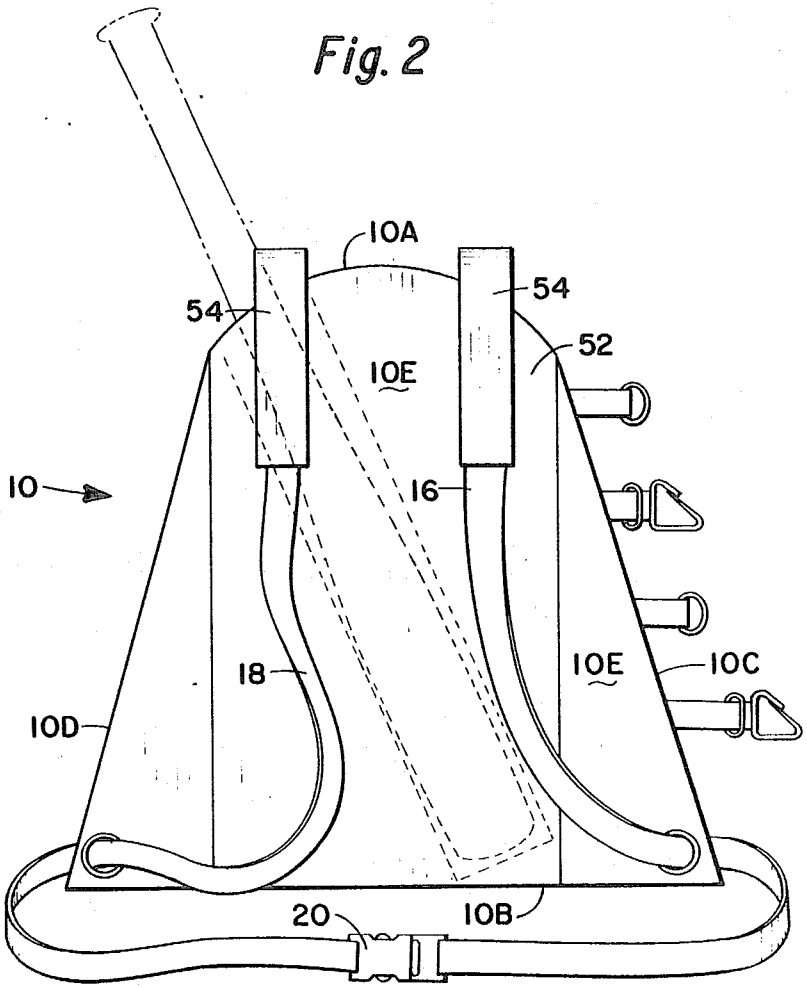
FIG. 2 is a front view of the pack of FIG. 1 as ready to be positioned on a user.

The sport pack can be made as comfortable as desired such as by including foam padding 52 on the front surface 10E of the back portion which contacts the back of the user (See FIG. 2). Padding 54 may be employed on the straps 16 and 18 where the straps extend across the top of the shoulders of the user. Velcro type closers may be employed for the pockets.

The invention thus provides a unique sport pack for use by boys to retain their playing equipment in a collected, confined area and in which the equipment can be easily transportted when walking, or riding a bicycle.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A pack for wearing on the back of a user for carrying sport equipment, the pack comprising;

a back portion of flexible material having a front and back surface and being configured and dimensioned to be received on the back of the user with the front surface in contact with the user, the back portion having an upper edge, a lower edge, a right side edge and a left side edge, and having a first opening therein adjacent the lower edge and right side edge and a second opening therein adjacent the lower edge and left side edge;

a left shoulder strap and a right shoulder strap, each strap being attached at one end to said back portion upper edge, the right shoulder strap extending forwardly of said back portion and through said first opening and the left shoulder strap extending forwardly of said back portion and through said second opening, the other ends of the straps being attachable to each other in front of the user;

a generally tubular, elongated member affixed to the said back surface of said back portion and extending diagonally across said back portion, the tubular member being open at the top and closed at the bottom and adapted to receive an elongated sports item therein, such as a baseball bat, hockey stick, tennis racket and the like;

a second generally tubular member affixed to said back surface of said back portion and extending diagonally at an angle to said first mentioned tubular member and being of length less than said first mentioned tubular member; and a sack member of flexible material secured to said back portion back surface and being open in the top and adaptable to receive balls and other playing equipment therein.

2. A pack for wearing on the back of a user according to claim 1 including a draw string in the top edge of said sack member.

3. A pack for wearing on the back of a user according to claim 1 including at least one short strap affixed to said back portion back surface adjacent one of said side edges, including means to fasten said strap whereby a ball glove or the like may be retained.

4. A pack for wearing on the back of a user according to claim 1 including at least one pocket secured to said back portion back surface adjacent one of said side edges.

* * * * *